United States Patent [19]

Brammer et al.

[11] Patent Number: 4,893,677

[45] **Date of Patent: * Jan. 16, 1990**

[54] GUIDELINELESS REENTRY SYSTEM WITH RETRACTING ROLLERS

[75] Inventors: Norman Brammer, Turriff, Scotland; Charles E. Jennings, Houston, Tex.

[73] Assignee: Vetco Gray Inc., Houston, Tex.

[ * ] Notice: The portion of the term of this patent subsequent to Apr. 25, 2006 has been disclaimed.

[21] Appl. No.: 278,898

[22] Filed: Dec. 2, 1988

Related U.S. Application Data

[63] Continuation-in-part of Ser. No. 99,360, Sep. 21, 1987, abandoned.

[51] Int. Cl.[4] ..... E21B 43/013

[52] U.S. Cl. ..... 166/341; 166/345; 166/359; 285/24

[58] Field of Search ..... 166/341, 345, 342, 343, 166/349, 339, 359, 344; 285/24, 27, 920; 405/169

[56] References Cited

U.S. PATENT DOCUMENTS

| | | | |
|---|---|---|---|
| 3,500,906 | 3/1970 | Petersen | 166/341 |
| 3,517,738 | 6/1970 | Petersen | 166/349 |
| 3,675,713 | 7/1972 | Watkins | 285/18 X |
| 3,688,840 | 9/1972 | Curington et al. | 166/341 |
| 4,167,215 | 9/1979 | Thorne | 166/341 |
| 4,171,922 | 10/1979 | Coulboy et al. | 166/341 X |
| 4,375,835 | 3/1983 | Archer | 166/359 X |
| 4,399,872 | 8/1983 | McConanghy | 166/341 |
| 4,609,046 | 9/1986 | Schwann et al. | 166/341 |
| 4,662,785 | 5/1987 | Gibb et al. | 405/195 |
| 4,823,878 | 4/1989 | Brammer et al. | 166/341 |
| 4,823,879 | 4/1989 | Brammer et al. | 166/341 |

OTHER PUBLICATIONS

Technip—Geoproduction Swims.

Vetcogray—Offshore Drilling & General Catalog 1986–1987.

*Primary Examiner*—Hoang C. Dang

*Attorney, Agent, or Firm*—James E. Bradley

[57] ABSTRACT

A guidelineless reentry system for a subsea well uses a downward facing funnel. The well has a mandrel surrounded by a guide frame. A funnel and a mandrel connector are carried by the riser. Retracting rollers are mounted to the funnel. Once the riser lands on the guide frame, the rollers are extended to latch the funnel to the guide frame. The funnel is rotated along with the riser to orient the mandrel connector. The mandrel connector is lowered relative to the funnel into engagement with the mandrel.

8 Claims, 3 Drawing Sheets

Fig. 1
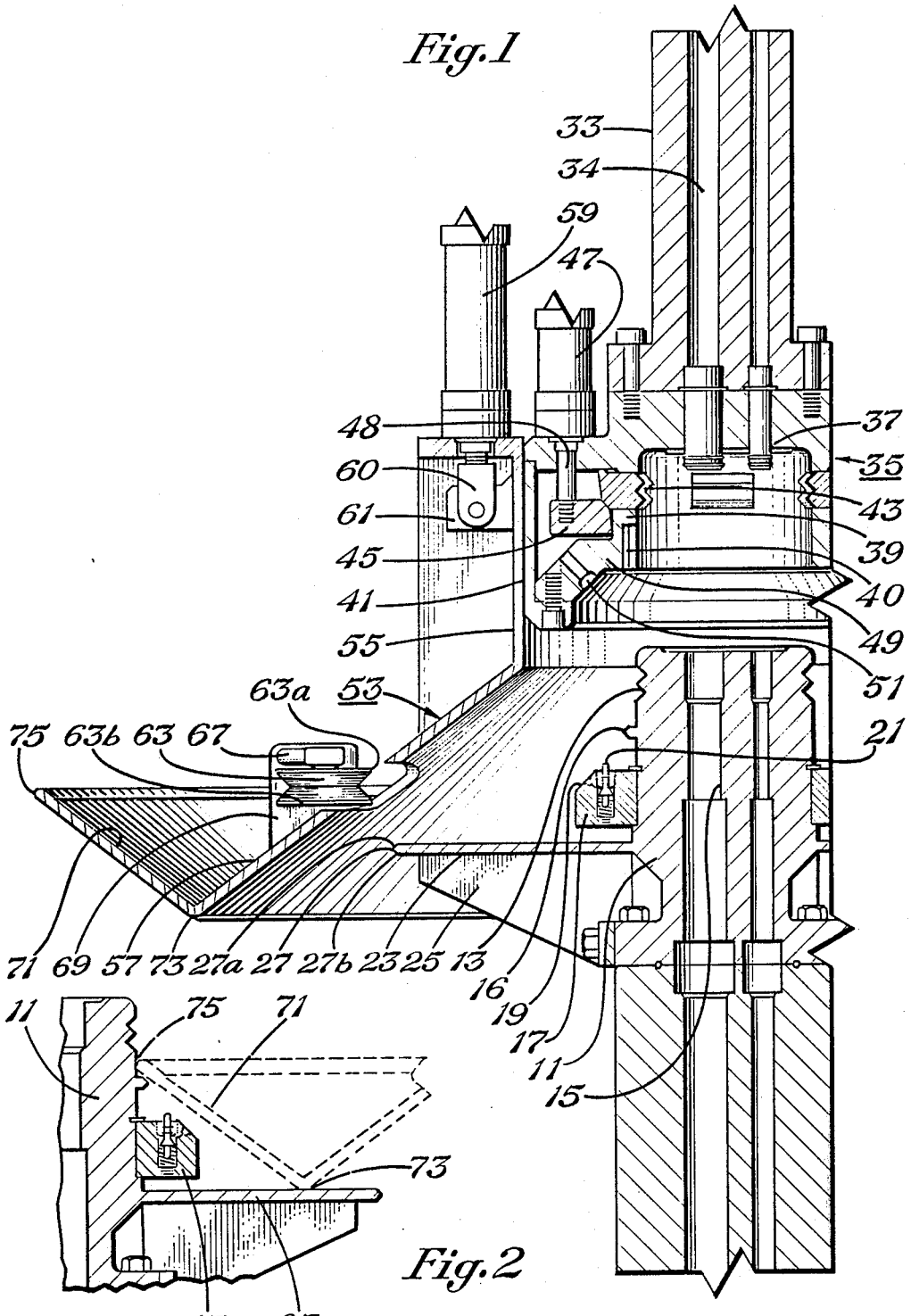
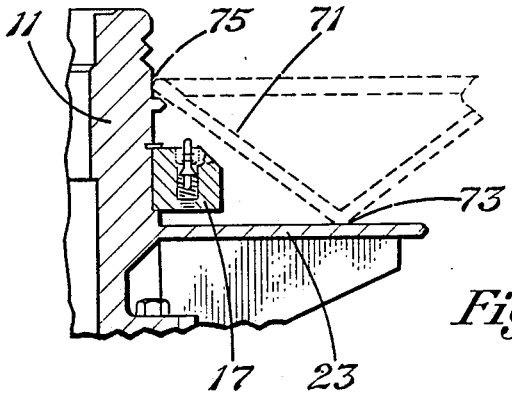
Fig. 2

GUIDELINELESS REENTRY SYSTEM WITH RETRACTING ROLLERS

This application is a continuation-in-part of application Ser. No. 099,360, filed Sept. 21, 1987 abandoned. There are two other applications by the same inventors, entitled "Guidelineless Reentry System With Nonrotating Funnel", Ser. No. 106,837, filed Oct. 8, 1987 U.S. Pat. No. 4,825,879, and "Guidelineless Reentry System With Fixed Rollers", Ser. No. 106,838, filed Oct. 8, 1987 U.S. Pat. No. 4,838,878.

BACKGROUND OF THE INVENTION

1. Field of the Invention:

This invention relates in general to subsea wells, and in particular to a system for reconnecting a riser from a floating vessel to a subsea well for workover operations.

2. Description of the Prior Art:

In deep water offshore oil and gas wells, the Christmas tree of the well will often be located on the subsea floor. At times, a workover operation must be performed on the subsea well. When this is required, a floating vessel is positioned over the well. A string of riser pipe is lowered down into engagement with a mandrel on the subsea tree. Once in engagement, operations can be performed on the well.

If the system is a guidelineless system, there will be no guidelines extending upward from the subsea well structure to the surface. Generally, in a guidelineless system, a large upwardly facing funnel is mounted permanently on the subsea tree. The funnel, with the aid of television cameras, assists in guiding the lower end of the riser onto the mandrel of the subsea well. The funnel can be quite large, up to twelve feet in diameter. A funnel of this type is expensive to construct and is only used when a workover operation is performed or when a tree cap is installed.

Mounting a downward facing funnel on the riser would avoid the need for a permanent upward facing funnel on each well. However, a funnel rigidly mounted to the lower end of the riser would require an extra high mandrel extending above the control mechanisms on the tree, so as to insure that the funnel did not strike any of various control mechanisms on the side of the tree. Hydraulic connections must also be made up when the riser lands on a mandrel to connect the controls of the tree to the floating platform. Orienting the funnel onto the mandrel of the Christmas tree without damage to the hydraulic manifold or valve block would be a problem.

There have been proposals to make the funnel retractable. The funnel would be located on the lower end of the riser, but would be vertically movable relative to the lower end of the riser by means of hydraulic rams. When first contacting the mandrel on the subsea well, the funnel would be extended. Once proper orientation has been made, the funnel would be retracted. During retraction, the riser and mandrel connector lower down into engagement with the mandrel. While these proposals have merit, improvements are desirable.

SUMMARY OF THE INVENTION

In this invention, a guide frame is mounted to the mandrel below the top of the mandrel. A mandrel connector is mounted to the lower end of the riser. The mandrel connector includes dogs which move radially out to lock the mandre connector to the mandrel.

A guide funnel is carried by the riser for insertion over the mandrel. The guide funnel will move from a lower extended position to an upper position. A plurality of rollers are carried by the funnel. Once the funnel has landed, the rollers are extended from a retracted position. In the extended position, the rollers latch the funnel to the guide frame and also allow rotation of the funnel.

Once the proper orientation has been achieved, the mandrel connector is lowered along with the riser onto the mandrel by retracting the funnel. The dogs are then moved into engagement with the mandrel by means of the cam.

A hydraulic manifold encircles the mandrel within the guide ring. The hydraulic manifold has a plurality of passages leading to equipment on the subsea well. A manifold connector is carried by the mandrel connector. The manifold connector is connected to lines that lead to the surface for supplying hydraulic fluid. When the mandrel is connected to the mandrel, the manifold connector will seat against the hydraulic manifold.

BRIEF DESCRIPTION OF THE DRAWING

FIG. 1 is a partial vertical sectional view illustrating a reentry system constructed in accordance with this invention, with the funnel positioned above the mandrel and in an extended position.

FIG. 2 is a partial sectional view of part of the deflector plate of the system of FIG. 1.

DESCRIPTION OF THE PREFERRED EMBODIMENT

Figures 3, 4:
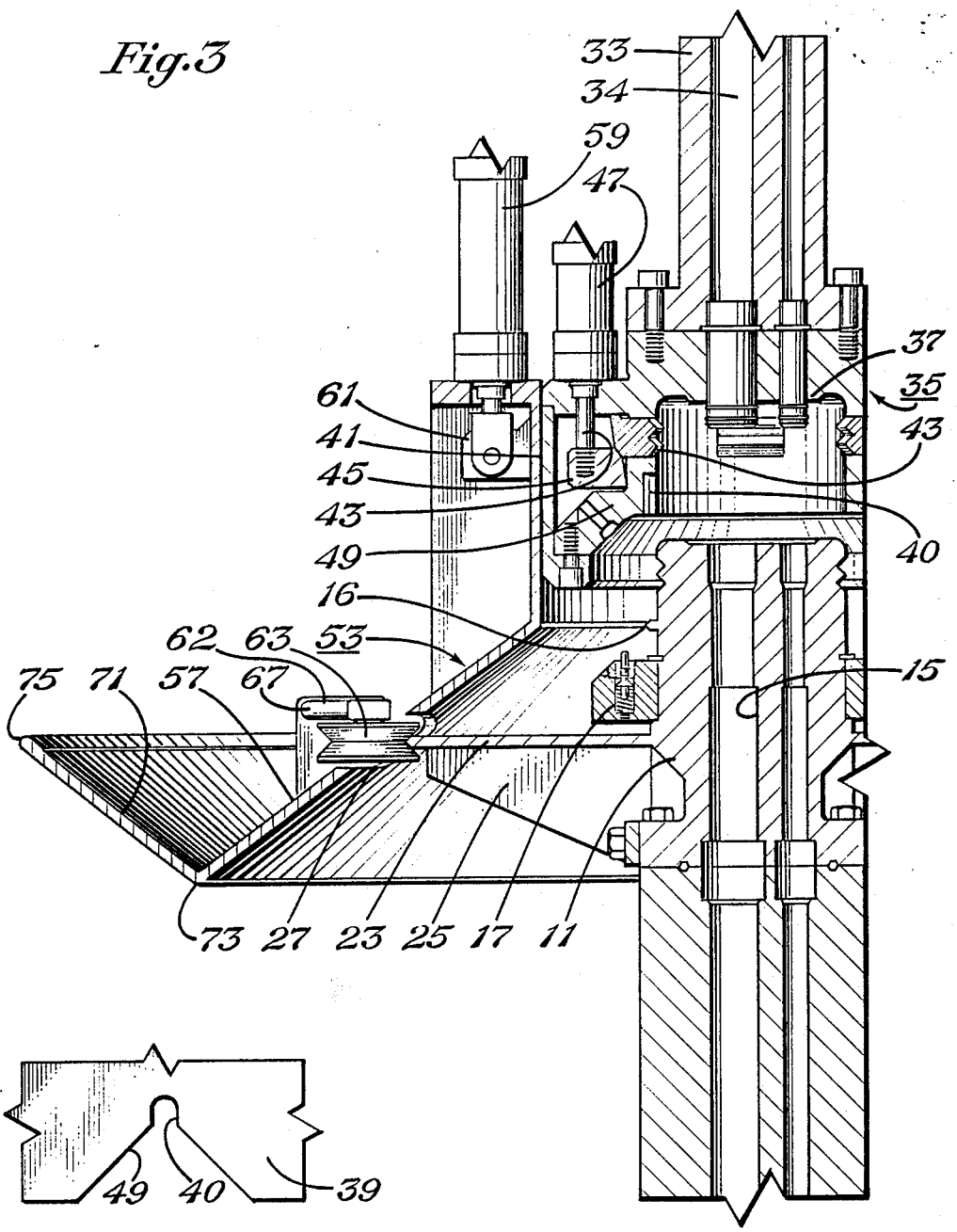
FIG. 3 is a partial vertical sectional view of the system of FIG. 1, showing the funnel latched to the guide frame.
FIG. 4 is an enlarged side view of the inside sidewall of the mandrel connector of the system of FIG. 1, showing a guide slot.

Referring to FIG. 1, the subsea well includes an upwardly facing mandrel 11. Mandrel 11 is a tubular member having a plurality of circumferential grooves 13 on its exterior near the upper end. Passages 15 extend through the mandrel 11 for communicating with the well. Normally, a cap (not shown) of some type will be located on top of the mandrel 11 and will be removed when the workover operation is beginning. A small cylindrical guide pin 16 is mounted to the sidewall of mandrel 11 and protrudes laterally outward.

A cone seal manifold 17 is mounted to the exterior of mandrel 11 below guide pin 16. Manifold 17 is an annular member with an upward and outward facing conical exterior. Manifold 17 has a plurality of passages 19 extending through it and spaced around its circumference. Each passage 19 contains a check valve 21. The passages 19 lead to lines (not shown) which lead to various other equipment, such as control valves, on the subsea well. A cone seal manifold 17 of this type is described in more detail in U.S. Pat. No. 4,754,813, issued July 19, 1988, Charles E. Jennings.

A guide frame 23 is mounted to the mandrel 11. Guide frame 23 comprises a flat annular plate that extends outward from the mandrel 11 a considerable distance. Gussets 25 are spaced around the bottom of the guide frame 23 to provide support. The outer edge 27 of the guide frame 23 is circular and is beveled on its upper surface 27*a* and lower surface 27*b*. The inclination of the upper surface 27*a* and the lower surface 27*b* is 45 degrees. This results in the surfaces 27*a* and 27*b* being 90 degrees relative to each other.

A riser 33 is shown being lowered from a floating vessel (not shown). Riser 33 is made up of sections of conduit. Passages 34 extend through the riser 33 for communication with the passages 15 in the mandrel. A mandrel connector 35 is rigidly mounted to the lower end of the riser 33 by bolts 36. The mandrel connector 35 has a top or upper plate 37 which is adapted to land on the top of the mandrel 11. A cylindrical inner sidewall 39 extends downward from the top 37. The inner diameter of the inner sidewall 39 is slightly greater than the outer diameter of the mandrel 11, allowing the inner sidewall 39 to slide down over the mandrel 11. A cylindrical outer sidewall 41 is spaced outward from the inner sidewall 39 and depends from the top 37.

A guide slot 40 is formed in the inside surface of the mandrel connector 35. Guide slot 40 extends upward from the lower edge of the inner sidewall 39. As shown in FIG. 4, guide slot 40 has two ramp portions 40*a* leading to a central cylindrical portion. The ramp portions 40*a* converge upwardly at a 45 degree angle. This makes the guide slot 40 much wider at the bottom than at the top. Guide slot 40 is adapted to receive the guide pin 16.

A plurality of dogs 43 are carried in windows in the inner sidewall 39. Each dog 43 has grooves on its inner face for engaging the grooves 13. Each dog 43 will move radially between an outward retracted position shown in FIGS. 1 and 3 and an inward locked position shown in FIG. 5.

The dogs 43 are moved inward by means of a cam member 45. Cam member 45 is a ring positioned in the clearance between the inner sidewall 39 and outer sidewall 41. Cam member 45 has an inclined inner face which engages the outer side of each dog 43. A plurality of hydraulic cylinders 47 are mounted to the top 37. The shaft 48 of each hydraulic cylinder 47 is connected to the cam member 45 for raising the cam member to push the dogs 43 inward.

A manifold connector 49 is rigidly mounted to the mandrel connector 35. The manifold connector 49 is a metal block having a conical inner side that faces downward and inward. A plurality of passages 51 extend through the manifold connector 49. The passages 51 are connected to lines (not shown) which lead to the floating vessel for supplying hydraulic fluid. The passages 51 are positioned to align and register with the passages 19 in the cone seal manifold 17.

An upper guide frame or funnel 53 is carried by the mandrel connector 35. Funnel 53 has an upper cylindrical portion 55. The cylindrical portion 55 is closely and slidingly carried on the outside of the mandrel connector outer sidewall 41. A lower frustoconical portion 57 extends downward from the cylindrical portion 55. The conical portion 57 faces downward. Conical portion 57 is considerably larger in diameter than the guide frame 23.

A plurality of hydraulic cylinders 59 are mounted on the upper end of the funnel 53. The shaft 60 of each hydraulic cylinder 59 is connected to a bracket 61. Bracket 61 is secured rigidly to the outer sidewall 41 of the mandrel connector 35. The hydraulic cylinders 59 will move the funnel 53 between an extended position relative to the mandrel connector 35, shown in FIGS. 1 and 3, and a retracted position shown in FIG. 5.

A plurality of rollers 63 are rotatably mounted to the conical portion 57 of funnel 53. The rollers 63 are adapted to extend through holes 65 in the conical portion 57. The rollers 63 are positioned to contact the edge 27 of the guide frame 23. Each roller 63 has a V-shaped rim. An upper surface 63*a* is adapted to mate with the guide frame upper edge surface 27*a*. A lower surface 63*b* is adapted to mate with the guide frame lower edge surface 27*b*. The surfaces 63*a*, 63*b* intersect each other at a 45 degree angle. The rollers 63 allow the funnel 53 to be rotated relative to the guide frame 23. Also, the rollers 63 latch the funnel 53 to the guide frame 23 because of the contact of the lower roller surface 63*b* with the guide frame edge lower surface 27*b*. The latching of the rollers prevent upward movement of the funnel 53 relative to the guide frame 23, and allowing tensioning of the riser 33.

Each roller 63 is horizontally mounted to the funnel 53 A plurality of hydraulic cylinders 67, each mounted to a brace 69, serve as means to extend and retract each roller 63. In the retracted position shown in FIG. 1, no portion of any roller 63 protrudes into the interior of funnel 53. In the extended position shown in FIGS. 3 and 5, the rollers 63 extend into the interior of the funnel 53 through the holes 65.

A conical deflector plate 71 is rigidly mounted to the lower edge of the funnel conical portion 57. Deflector plate 71 extends upward and outward. The lower edge 73 joins the lower edge of the funnel conical portion 57. The upper edge 75 is of larger diameter than the lower edge 73. Referring to FIG. 2, the degree of the taper of the deflector plate 71 and the distance between the lower and upper edges 73, 75 is selected to avoid damage to manifold 17. The degree of taper relative to vertical of the deflector plate 71 is about the same as the conical face of the manifold 17.

If the funnel 53 is misaligned while lowering such that the the upper edge 75 would touch the side of mandrel 11, as shown in FIG. 2, the lower edge 73 would touch the guide frame 23. The deflector plate 71 extends over the manifold 17 in that event. No portion of the deflector plate 71 would touch the manifold 17. This provides protection for the manifold 17.

In operation, when the subsea well needs workover operations, the upper protector cap (not shown) will be removed by various means. The riser 33 will be lowered from the vessel (not shown) to a point above the mandrel 11. Because there will be no guide lines to assure precise alignment, the funnel 53 may be considerably out of alignment with the mandrel 11 initially. Current and wave movement make precise alignment difficult. If the funnel 53 accidentally contacts only one side of the guide frame 23, completely missing the mandrel, the deflector plate 71 will avoid damage to the manifold 17. Television cameras located adjacent the funnel 53 will assist in aligning the funnel 53. Prior to lowering the funnel 53 onto the guide frame 27, the riser 33 will be rotated until the funnel 53 is oriented within about 90 degrees of proper orientation, as observed at the surface by the television cameras.

The riser 33 is then lowered. The funnel 53 may contact the upper edge of the mandrel 11 prior to touching the guide frame 23. If so, it will slide laterally and downward as the riser 33 is lowered. The conical portion 57 will touch the upper surface 27*a* of the guide frame 23 and eventually slide into full engagement as shown in FIG. 3. At this point, the riser 33 is generally coaxial with the mandrel 11.

The hydraulic cylinders 67 are actuated to extend rollers 63. The rollers 63 will contact the edge 27 of the guide frame 23. This latches the funnel 53 to the guide frame 23, but still allows rotation. The funnel 53 will still be in the extended position relative to the mandrel connector 35 as shown in FIG. 3. The mandrel connector 35 will be spaced above the mandrel 11. An upward pull is then executed on the riser 33 to straighten and tension it. The rollers 63 hold the funnel 53 to the guide frame 23 against upward movement The riser 33 will be in tension throughout its length.

Then, while the riser is still under tension, the riser 33 will be rotated for more precise orientation of the mandrel connector 35. The mandrel connector 35 and funnel 53 rotate in unison with the riser 33. The rollers 63 will roll on the edge 27 of the guide frame 23. When close to the proper orientation, the passages 34 in the mandrel connector 35 will be aligned with the passages 15 in the mandrel 11. The passages 51 in the manifold connector 49 will be aligned with the passages 19 in the cone seal manifold 17.

Then, while still holding the riser in tension, the funnel 53 is retracted relative to riser 33. During the retraction movement, funnel 53 does not actually move. Rather, the hydraulic cylinders 59 stroke downward, allowing the riser 33 and mandrel connector 35 to move downward. The hydraulic cylinder 59 will act against the tension hold on the riser, pulling the mandrel connector 35 downward. The guide slot 40 will slide over the guide pin 16, precisely orienting the mandrel connector 35. Some rotation of the funnel 53 may take place due to contact of pin 16 with the ramp portions 40*a* of the guide slot 40.

Figure 5:
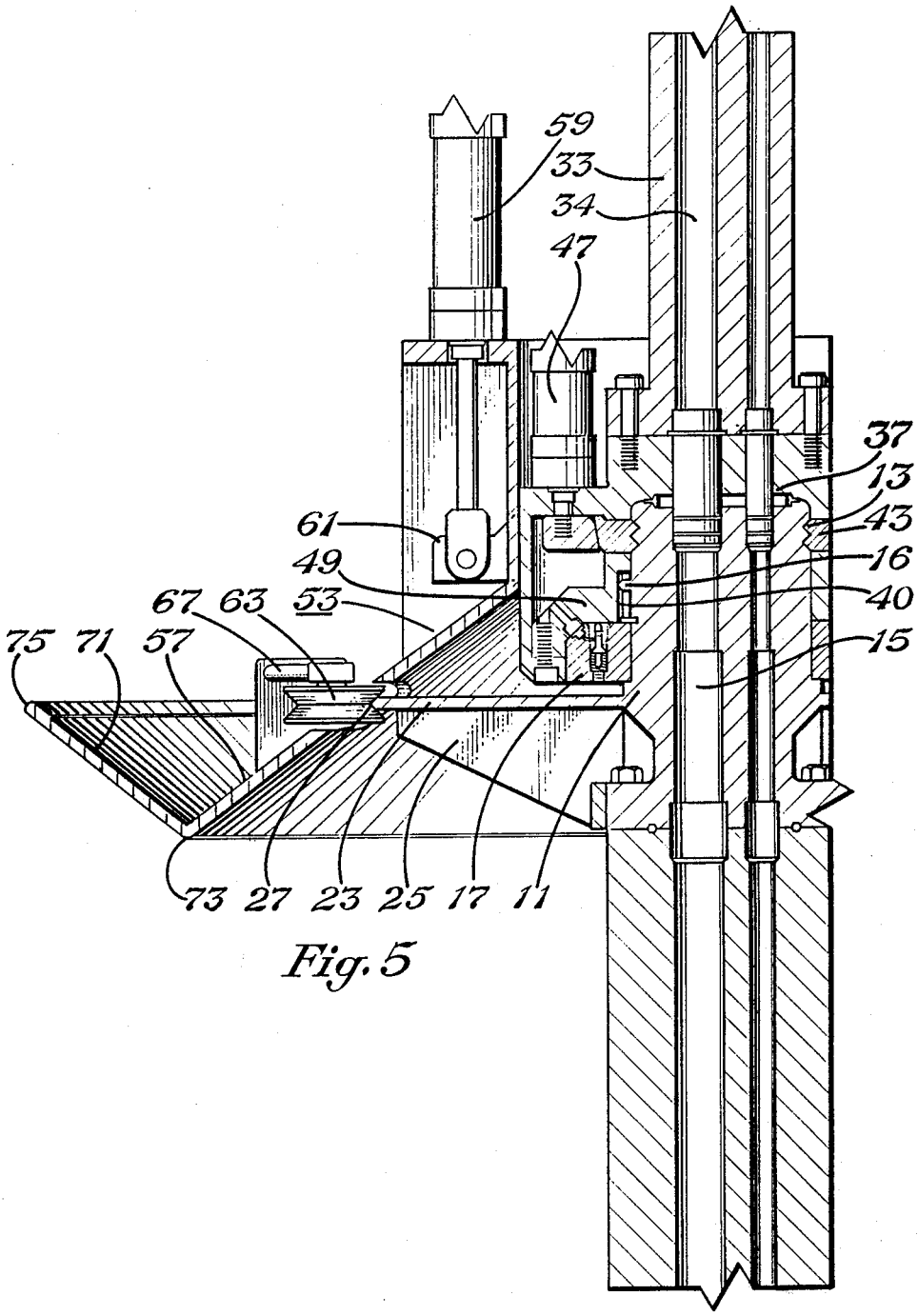
FIG. 5 is a partial vertical sectional view of the system of FIG. 1, with the funnel retracted and with the mandrel connector locked to the mandrel.

The mandrel connector 35 will land on top of the mandrel 11. This causes sealing communication between the passages 34 and 15. At the same time, the manifold connector passages 51 will register with the cone seal manifold passages 19. As shown in FIG. 5, the manifold connector 49 will be in contact with the cone seal manifold 17. The check valve 21 is depressed by the manifold connector 49. This redirects the fluid passages so that hydraulic fluid from the floating vessel will communicate with the controls on the subsea well.

Next, hydraulic fluid pressure is supplied to the hydraulic cylinders 47. This causes the shafts 48 to retract from the position shown in FIG. 3 to that shown in FIG. 5. As they retract, the cam member 45 pushes the dogs 43 inward to tightly engage the grooves 13. This also pulls the manifold connector 49 into tight engagement with the cone seal manifold 17. Workover operations may then take place.

After the workover operations have been completed, the funnel 53 may be removed. Hydraulic pressure is supplied to the hydraulic cylinders 47 to move the cam member 45 downward. This movement frees the dogs 43 to retract. Hydraulic pressure is supplied to the hydraulic cylinders 59 to move the mandrel connector 35 up relative to the funnel 53 and mandrel 11. Hydraulic pressure is supplied to the hydraulic cylinders 67 to retract the rollers 63. The riser 33 and funnel 53 may then be pulled to the surface.

The invention has significant advantages. Utilizing a downward facing funnel on the riser avoids the need for large structural funnels mounted to the subsea wells. The mandrel height is no higher than that required at a normal Christmas tree. Hydraulic controls are made up simulataneously with the locking of the mandrel connector to the mandrel. The retracting rollers provide latching action as well as allowing the funnel to rotate on the guide frame. The latching rollers allow tension to be placed in the riser before the mandrel connector is moved downward around one mandrel. The deflector plate reduces the chance for damage to the cone seal manifold.

While the invention has been shown in only one of its forms, it should be apparent to those skilled in the art that it is not so limited, but is susceptible to various changes without departing from the scope of the invention.

We claim:

1. An apparatus for connecting a riser extending from a floating vessel to a subsea well assembly of the type having an upward extending tubular mandrel with a plurality of grooves on its exterior, comprising in combination:

a guide frame mounted to the mandrel a selected distance below the top of the mandrel;

an annular hydraulic manifold mounted to the mandrel above the guide frame and below the top of the mandrel, having a plurality of hydraulic passages for communicating hydraulic fluid delivered from the floating vessel to equipment on the subsea well;

a mandrel connector mounted to the lower end of the riser for landing on the top of the mandrel to communicate the interior of the mandrel with the interior of the riser;

a plurality of dogs carried by the mandrel connector for radial movement between an outer retracted position and an inner locked position in engagement with the grooves on the mandrel;

cam means carried by the mandrel connector and hydraulically actuated for moving the dogs between the retracted and locked positions;

an annular hydraulic manifold connector mounted to the mandrel connector, having a plurality of hydraulic passages for connection to a supply of hydraulic fluid on the vessel, the manifold connector being positioned to engage the manifold;

a downward facing guide funnel carried by the riser for insertion over the mandrel into engagement with the guide frame;

roller means carried by the funnel for latching the funnel to the guide frame for preventing upward movement of the funnel relative to the guide frame and for allowing rolling engagement of the funnel relative to the guide frame after the funnel has latched to the guide frame to allow the mandrel connector to be rotated to a proper orientation;

means operatively connected between the mandrel connector and funnel for moving the funnel from a lower extended position relative to the riser and mandrel connector as the funnel is being lowered into engagement with the guide frame to an upper retracted position once the funnel has landed on the guide frame, causing the riser and mandrel connector to move downward relative to the funnel onto the mandrel and the manifold connector onto the manifold, and positioning the cam means around the mandrel, to allow the cam means to operate to move the dogs to the locked position to secure the mandrel connector to the mandrel.

2. An apparatus for connecting a riser extending from a floating vessel to a subsea well assembly of the type having an upward extending tubular mandrel, comprising in combination:

a guide frame mounted to the mandrel;

a mandrel connector mounted to the lower end of the riser;

connection means carried by the mandrel connector for connecting the mandrel connector to the mandrel;

a downward facing guide funnel carried by the riser for insertion over the mandrel into engagement with the guide frame;

roller means carried by the funnel for latching the funnel to the guide frame for preventing upward movement of the funnel relative to the guide frame and for allowing rolling engagement of the funnel relative to the guide frame after the funnel has latched to the guide frame to allow the mandrel connector to be rotated to a proper orientation;

means mounted to the funnel for moving the roller means relative to the funnel between a retracted position prior to contact of the funnel with the guide frame and an engaged position in latching and rolling engagement with the guide frame; and means operatively connected between the mandrel connector and funnel for moving the riser and mandrel connector downward relative to the funnel onto the mandrel after the mandrel connector has been rotated to substantially the proper orientation, positioning the connection means around the mandrel for securing the mandrel connector to the mandrel.

3. An apparatus for connecting a riser extending from a floating vessel to a subsea well assembly of the type having an upward extending tubular mandrel, comprising in combination:

a guide frame mounted to the mandrel and having a generally circular edge, the edge having a generally downward facing surface and also a generally upward facing surface;

a mandrel connector mounted to the lower end of the riser for landing on the top of the mandrel to communicate the interior of the mandrel with the interior of the riser;

connection means carried by the mandrel connector for engaging the sidewall of the mandrel to secure the mandrel connector to the mandrel;

a downward facing guide funnel carried by the riser and having a frusto-conical lower side for insertion over the mandrel into engagement with the edge of the guide frame;

a plurality of rollers carried by the funnel, each located next to a hole formed in the funnel, each roller having a generally downward facing surface for rolling contact with the upward facing surface on the edge of the guide frame, each roller having also a generally upward facing surface for rolling contact with the downward facing surface on the edge of the guide frame to latch the funnel to the guide frame;

means mounted to the funnel for moving the rollers between a retracted position spaced outward from the interior of the funnel and an engaged position protruding through the holes into engagement with the edge of the guide frame, the rollers latching the funnel to the guide frame and allowing the funnel to rotate relative to the guide frame to orient the mandrel connector to a proper orientation relative to the mandrel; and means operatively connected between the mandrel connector and funnel for hydraulically moving the riser and mandrel connector downward relative to the funnel onto the mandrel after the rollers have engaged the edge of the guide frame and the riser has rotated the funnel and mandrel connector to substantially the proper orientation, positioning the connection means around the mandrel, to allow the connection means to operate to secure the mandrel connector to the mandrel.

4. An apparatus for connecting a riser extending from a floating vessel to a subsea well assembly of the type having an upward extending tubular mandrel having a plurality of circular grooves on its exterior, comprising in combination:

a guide frame mounted to the mandrel a selected distance below the top of the mandrel, the guide frame having a peripheral edge with a generally upward facing surface and a generally downward facing surface;

an annular hydraulic control manifold mounted to the mandrel above the guide frame, having a plurality of hydraulic passages for communicating hydraulic fluid to equipment on the subsea well;

a mandrel connector mounted to the lower end of the riser;

an annular hydraulic control manifold connector mounted to the mandrel connector, having a plurality of hydraulic passages for connection to a supply of hydraulic fluid on the vessel, the manifold connector being positioned to engage the manifold with the hydraulic passages of each in alignment with the other;

a plurality of dogs carried by the mandrel connector for radial movement between an outer retracted position and an inner locking position in engagement with the grooves on the mandrel;

cam means carried by the mandrel connector and hydraulically actuated for moving the dogs between the retracted and locking positions;

a downward facing guide funnel carried by the riser for insertion over the mandrel into engagement with the guide frame, the guide funnel having a plurality of holes formed therethrough;

a roller carried by the funnel next to each hole, each roller having a generally upward facing surface for rolling contact with the downward facing surface of the guide frame edge to latch the funnel to the guide frame, each roller having a generally downward facing surface for rolling contact with the upward facing surface of the guide frame edge to allow the funnel to be rotated on the guide frame to rotate the mandrel connector to a proper orientation relative to the mandrel;

means carried by the funnel for moving the rollers between a retracted position located outward from the interior of the funnel and an engaged position, protruding through the holes and engaging the guide frame edge; and means mounted to the mandrel connector and funnel for moving the riser and mandrel connector downward relative to the funnel onto the mandrel and the manifold connector onto the manifold after the rollers have engaged the guide frame edge and the mandrel connector has been rotated to substantially the proper orientation, positioning the dogs adjacent the grooves, enabling the cam means to move the dogs into the locking position.

5. An apparatus for connecting a riser extending from a floating vessel to a subsea well assembly of the type having an upward extending tubular mandrel, comprising in combination:

a guide frame mounted to the mandrel a selected distance below the top of the mandrel;

a mandrel connector mounted to the lower end of the riser, the mandrel connector having a generally cylindrical sidewall for close reception over the mandrel;

connection means carried by the mandrel connector for connecting the mandrel connector to the mandrel;

a downward facing guide funnel carried by the riser for insertion over the mandrel into engagement with the guide frame;

roller means carried by the funnel for latching the funnel to the guide frame to prevent upward movement of the funnel relative to the guide frame and for allowing rolling engagement of the funnel relative to the guide frame after the funnel has latched to the guide frame to allow the mandrel connector to be rotated to a proper orientation;

means mounted to the funnel for moving the roller means relative to the funnel between a retracted position prior to contact of the funnel with the guide frame and an engaged position in latching and rolling engagement with the guide frame;

a guide slot formed in the sidewall of the mandrel connector;

a guide pin protruding laterally from the mandrel above the guide frame for engagement by the guide slot to properly orient the mandrel connector; and means operatively connected between the mandrel connector and funnel for moving the riser and mandrel connector downward relative to the funnel onto the mandrel after the mandrel connector has been rotated to the proper orientation and the guide pin has engaged the guide slot, positioning the connection means around the mandrel for securing the mandrel connector to the mandrel.

6. An apparatus for connecting a riser extending from a floating vessel to a subsea well assembly of the type having an upward extending tubular mandrel, comprising in combination:

a guide frame mounted to the mandrel a selected distance below the top of the mandrel;

an annular hydraulic manifold mounted to the mandrel above the guide frame and below the top of the mandrel, having a plurality of hydraulic passages for communicating hydraulic fluid delivered from the floating vessel to equipment on the subsea well;

a mandrel connector mounted to the lower end of the riser for landing on the top of the mandrel to communicate the interior of the mandrel with the interior of the riser;

connection means carried by the mandrel connector for connecting the mandrel connector to the mandrel;

an annular hydraulic manifold connector mounted to the mandrel connector, having a plurality of hydraulic passages for connection to a supply of hydraulic fluid on the vessel, the manifold connector being positioned to engage the manifold;

a downward facing frusto-conical guide funnel carried by the riser for insertion over the mandrel into engagement with the guide frame;

a generally frusto-conical deflector plate extending upward and outward from the periphery of the funnel to prevent the funnel from striking the manifold as the funnel is lowered over the mandrel; and means operatively connected between the mandrel connector and funnel for hydraulically moving the riser and mandrel connector downward relative to the funnel onto the mandrel and the manifold connector onto the manifold after the funnel has landed on the guide frame, positioning the connection means around the mandrel to allow the connection means to operate to secure the mandrel connector to the mandrel.

7. An apparatus for connecting a riser extending from a floating vessel to a subsea well assembly of the type having an upward extending tubular mandrel, comprising in combination:

a guide frame mounted to the mandrel a selected distance below the top of the mandrel;

an annular hydraulic manifold mounted to the mandrel above the guide frame and below the top of the mandrel, having a plurality of hydraulic passages for communicating hydraulic fluid delivered from the floating vessel to equipment on the subsea well;

a mandrel connector mounted to the lower end of the riser for landing on the top of the mandrel to communicate the interior of the mandrel with the interior of the riser;

connection means carried by the mandrel connector for connecting the mandrel connector to the mandrel;

an annular hydraulic manifold connector mounted to the mandrel connector, having a plurality of hydraulic passages for connection to a supply of hydraulic fluid on the vessel, the manifold connector being positioned to engage the manifold;

a downward facing frusto-conical guide funnel carried by the riser for insertion over the mandrel into engagement with the guide frame;

a generally frusto-conical deflector plate extending upward and outward from the periphery of the funnel, the length of the deflector plate being selected so that when the lower edge of the deflector plate touches the guide frame and the upper edge touches the mandrel, the deflector plate will extend over the manifold to prevent the funnel from striking the manifold as the funnel is lowered over the mandrel; and means operatively connected between the mandrel connector and funnel for hydraulically moving the riser and mandrel connector downward relative to the funnel onto the mandrel and the manifold connector onto the manifold after the funnel has landed on the guide frame, positioning the connection means around the mandrel to allow the connection means to operate to secure the mandrel connector to the mandrel.

8. A method for connecting a riser extending from a floating vessel to a subsea well assembly of the type having an upward extending tubular mandrel, comprising in combination:

mounting a guide frame to the mandrel;

mounting a mandrel connector to the lower end of the riser;

mounting a downward facing guide funnel to the mandrel connector for vertical movement relative to the mandrel connector;

mounting a plurality of retractable rollers to the funnel configured for latching the funnel to the guide frame against upward movement of the funnel on the guide frame and for allowing rolling engagement of the funnel on the guide frame;

lowering the funnel onto the guide frame; then extending the rollers relative to the funnel to latch the funnel to the guide frame; then pulling upward on the riser with the rollers holding the funnel on the guide frame; and rotating the funnel and mandrel connector relative to the guide frame to orient the mandrel connector while still applying tension to the riser; then moving the mandrel connector downward relative to the funnel into engagement with the mandrel and connecting the mandrel connector to the mandrel.

* * * * *

UNITED STATES PATENT OFFICE

CERTIFICATE OF CORRECTION

Patent No. 4,893,677 Dated 01/16/90

Inventor(s) Norman Brammer, Charles E. Jennings

It is certified that error appears in the above-identified patent and that said Letters Patent is hereby corrected as shown below:

At column 1, line 68, "mandre" is changed to--mandrel--;

At column 4, line 19, a period is inserted after "53";

At column 5, line 10, a period is inserted after "movement";

At column 6, line 51, after "orientation;", the word--and-- is inserted.

Signed and Sealed this

Twenty-first Day of May, 1991

*Attest:*

HARRY F. MANBECK, JR.

*Attesting Officer*

*Commissioner of Patents and Trademarks*